US006264148B1

(12) United States Patent
Chandler

(10) Patent No.: US 6,264,148 B1
(45) Date of Patent: Jul. 24, 2001

(54) METHOD AND APPARATUS FOR DISPLAYING ARTICLES

(75) Inventor: Paul E. Chandler, Plano, TX (US)

(73) Assignee: Chippenhook Corporation, Flower Mound, TX (US)

( * ) Notice: Subject to any disclaimer, the term of this patent is extended or adjusted under 35 U.S.C. 154(b) by 0 days.

(21) Appl. No.: 09/221,772

(22) Filed: Dec. 28, 1998

(51) Int. Cl.[7] ..... A47F 7/00

(52) U.S. Cl. ..... 248/116; 206/301; 206/566; 248/116; 368/316

(58) Field of Search ..... 248/114, 115, 248/116, 230.8, 220.21, 220.22, 222.14, 690, 693, 291.1, 292.12; 368/316; 206/566, 301, 45.13; 211/57.1; 40/642.01

(56) References Cited

U.S. PATENT DOCUMENTS 4,256,281 * 3/1981 Harris et al. ..... 248/231
4,270,201 * 5/1981 Pyne et al. ..... 368/316 X
4,293,943 * 10/1981 Avery et al. ..... 248/116 X
4,707,146 * 11/1987 Wein ..... 368/316
4,913,289 * 4/1990 Feiler ..... 206/566
5,076,523 * 12/1991 Wang ..... 248/222.1
5,775,653 * 7/1998 Horney et al. ..... 248/230.8
5,799,911 * 9/1998 Dostie et al. ..... 248/116
5,966,865 * 10/1999 Jones ..... 248/230.8 X

* cited by examiner

*Primary Examiner*—Leslie A. Braun
*Assistant Examiner*—Tan Le
(74) *Attorney, Agent, or Firm*—Baker Botts L.L.P.

(57) ABSTRACT

The present invention comprises an apparatus that provides retailers with a highly flexible and attractive means to display their articles. The apparatus includes a collar (120) adapted to receive the article. The apparatus also includes a support member (130) adapted to releasably engage a receptor (131) in the collar (120). Finally, the apparatus includes a base (140) which is adapted to receive the support member (120). More specifically, the collar (120) has at least one receptor (132) that is not centrally located. In a further embodiment, the collar (120) receptor is geared to engage with a complimentary gear of the support member (130). In accordance with another aspect of the present invention, a method comprising three steps is disclosed for displaying articles. The method first mounts the article on a collar (120). The next step engages the collar (120) with a support member (130). The method then couples the support member (130) to a base (140). More specifically, the method further comprises mounting a securing tab (160) to secure the article. In a further embodiment, the method further comprises mounting a display marker.

20 Claims, 4 Drawing Sheets

FIG. 4
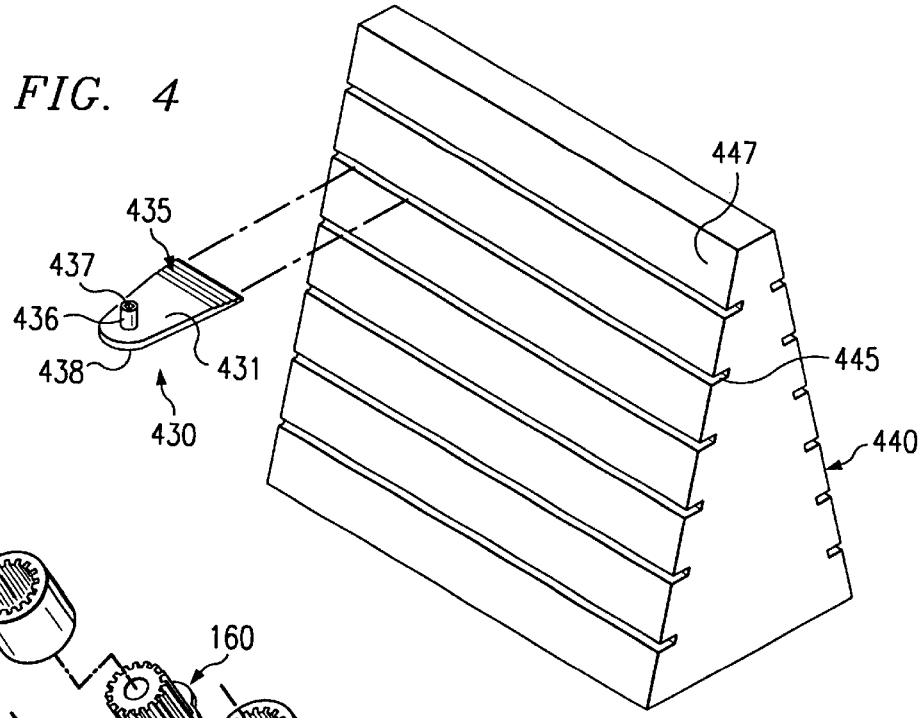
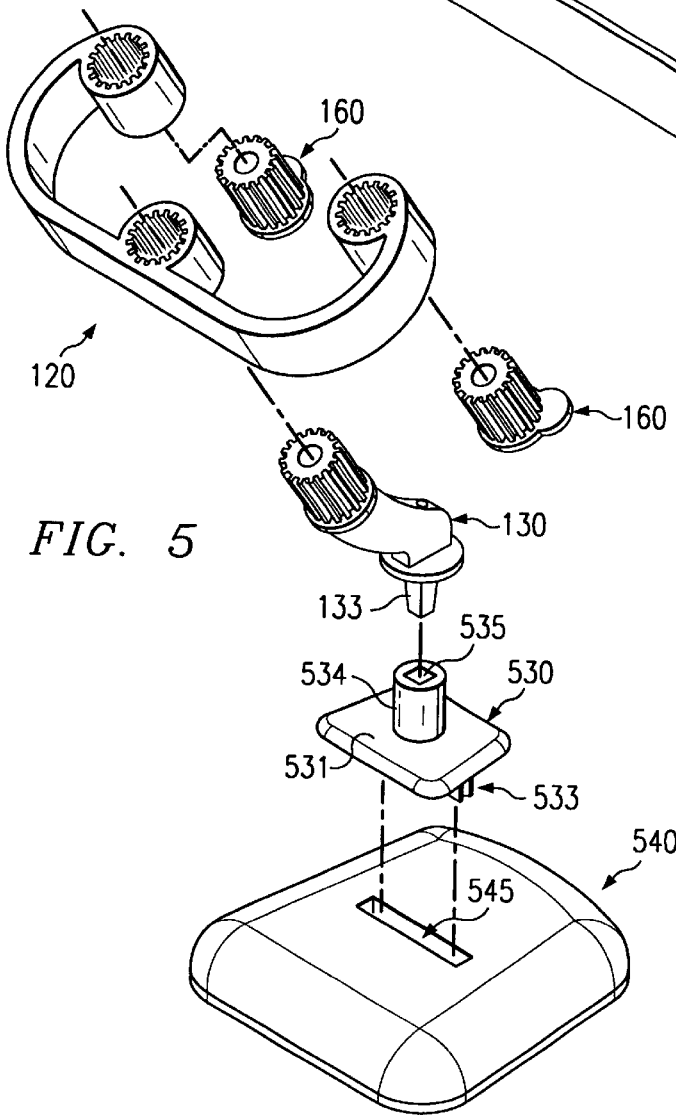
FIG. 5

METHOD AND APPARATUS FOR DISPLAYING ARTICLES

TECHNICAL FIELD OF THE INVENTION

This invention relates generally to the field of display devices for use in retail merchandising and more particularly to a method and apparatus for displaying articles.

BACKGROUND OF THE INVENTION

Retail merchandisers require an effective method of displaying and storing their articles, goods or merchandise, both to attract a customer's attention and to easily access the merchandise for customer examination. Articles such as watches or jewelry have typically been displayed in boxes. These are bulky and can display articles in a limited number of positions. This limits a retailers' ability to display articles in a creative and attractive manner, as well as a customer's ability to view and inspect the article.

In an effort to overcome these disadvantages, display packaging was developed to display articles without the use of a box. This permitted a less bulky means for retailers to display articles. However, the packaging still limited the display to one viewing angle. The packaging also limited the types of articles which might be displayed to strap-type watches.

Yet another approach, described in U.S. Pat. No. 5,136,557, provided for a modular design providing a collar that can be removed from a base. This modular design does not permit usage of various bases which are not adaptable to the collar. Another disadvantage to this approach is that it limits the display of articles to a vertical axis relative to the base. Finally, this approach does not provide a means to secure an article for display, while retaining the ease of removing the article from its position on the display device for examination by a customer. Therefore, a need has arisen for a new method and apparatus for displaying an article that overcomes the disadvantages and deficiencies of the prior art.

SUMMARY OF THE INVENTION

In accordance with the present invention, a method and an apparatus for displaying articles are provided which substantially eliminate or reduce the disadvantages and problems associated with prior devices that display articles.

The present invention comprises an apparatus that provides retailers with a highly flexible and attractive means to display their articles according to their needs. In accordance with one aspect of the invention, an apparatus provides a means for displaying articles. The apparatus includes a collar adapted to receive the article. The apparatus also includes a support member adapted to releasably engage a receptor in the collar. Finally, the apparatus includes a base which is adapted to receive the support member.

In a further embodiment, the collar receptor is geared to engage with a complimentary gear of the support member. The apparatus also includes a support member having one end adapted to releasably engage the receptor, and a base for receiving a second end of the support member.

More specifically, the apparatus allows the collar to be engaged with the support member in a multiplicity of angular positions, or in a multiplicity of discrete positions. In another embodiment, the support member further comprises an end adapted to engage a base adaptor, the base adaptor further having an end adapted to engage the base. In yet another embodiment, the collar has a surface structure adapted to secure the article.

In accordance with another aspect of the present invention, a method comprising three steps is disclosed for displaying articles. The method first mounts the article on a collar. The next step engages the collar with a support member. The method then couples the support member to a base. More specifically, the method further comprises mounting a securing tab to secure the article. In a further embodiment, the method further comprises mounting a display marker.

A technical advantage of the present invention is a method of displaying articles in a way that is easily modifiable and reconfigurable, to serve a larger variety of retail needs, as dictated by changes in retailer inventory. Another technical advantage of the present invention is an apparatus for displaying articles which effectively secures the article to the apparatus. Another technical advantage of the present invention is an apparatus to display articles which can be configured to display the articles in a multiplicity of angular positions. Another technical advantage of the present invention is an apparatus for displaying articles where the collar may be engaged with the support member in a multiplicity of discrete positions.

A further technical advantage of the present invention is an apparatus for displaying articles where the collar has at least one receptor that enables the article to be displayed in both a horizontal and vertical axis relative to a base. Another technical advantage of the present invention is an apparatus for displaying articles which is adaptable to a wide variety of bases.

BRIEF DESCRIPTION OF THE DRAWINGS

For a more complete understanding of the present invention, the objects and advantages thereof, reference is now made to the following descriptions taken in connection with e accompanying drawings in which:

FIG. 4 illustrates another embodiment of the invention with a base adaptor which may be used with a slot-wall, or as a self-standing base.

FIG. 5 shows the invention with securing tabs, supported by another embodiment of a base adaptor.

DETAILED DESCRIPTION OF THE INVENTION

The preferred embodiment of the present invention and its advantages are best understood by referring to FIGS. 1 through 5 of the drawings, like numerals being used for like and corresponding parts of the various drawings.

Figure 1:
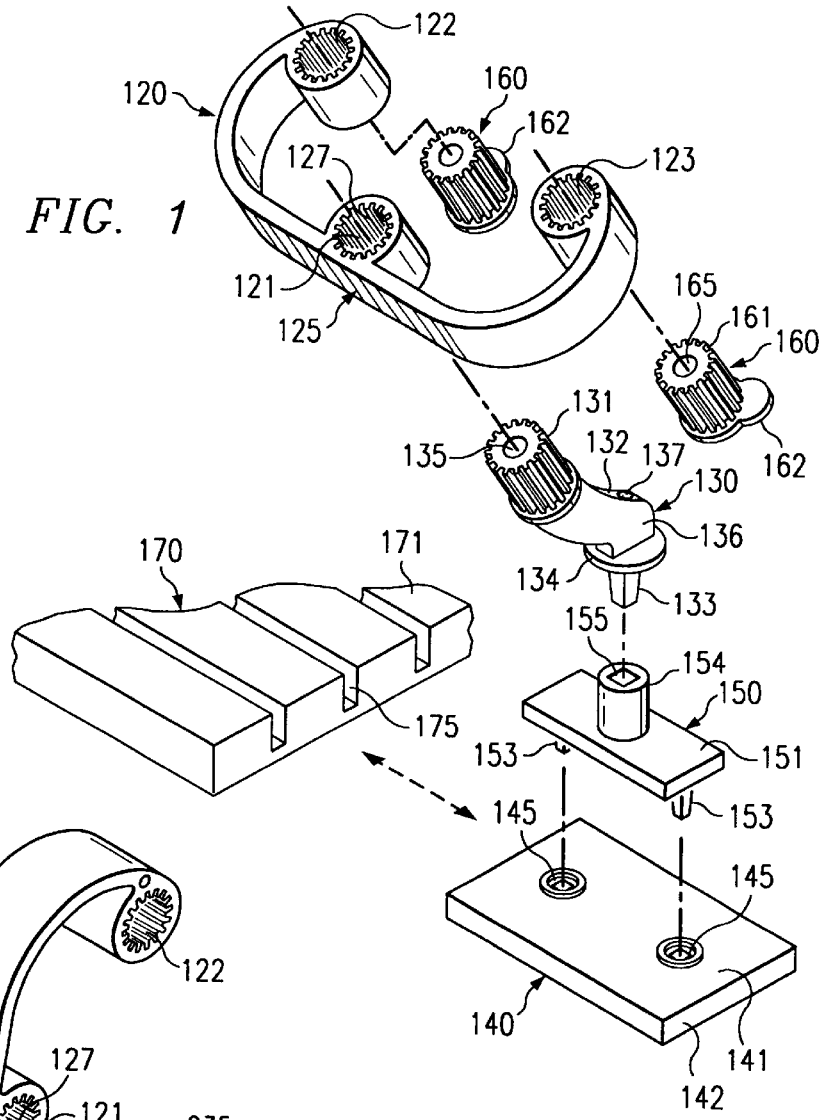
FIG. 1 shows an embodiment of the invention in a perspective view, where the collar is positioned horizontally.

FIG. 1 illustrates one embodiment of the invention where a collar 120 adapted to receive an article such as a watch (not shown) for display is oriented in a horizontal position. Collar 120 is generally C-shaped with a centrally located receptor 121 and receptors 122, 123, which are not centrally-located. Collar 120 is releasably engageable to a support member 130. Support member 130 is releasably engageable to a base adaptor 150. Base adaptor 150 is releasably engageable to bases 140 and 170. Collar 120 has, by way of example, a ribbed surface structure 125 adapted to more securely display the article.

Support member 130 may be releasably engaged with receptors 121, 122, and 123 in collar 120 in various angular positions to display the article in a variety of orientations. In the preferred embodiment, receptor 121 has a gear 127 to receive a first end 131 of support member 130, which is complimentarily geared. Gear 127 and complimentarily geared first end 131 may be coupled together to collar 120 in a plurality of discrete angular positions. The first end 131 of support member 130 is adapted to releasably engage receptor 121, but will remain securely positioned by friction. This may be accomplished, by way of example, by tapering complimentarily-geared first end 131 of support member 130 from a wider angle near neck 132 of support member 130 to a narrower end near receptor 135 of first end 131. Other suitable, complimentarily-shaped geometric structures for receptor 121 and first end 131 of support member 130 may also be used to releasably couple support member 130 and collar 120.

Support member 130 also has a second end 133 to releasably engage base adaptor 150. Second end 133 of support member 130 is adapted to releasably engage with receptor 155 of base adaptor 150 by means of tapering to remain secured by friction. Support member 130 also has a seat 134 to assist in releasably engaging support member 130 to base adaptor 150. First end 131 of support member 130 is generally offset from second end 133 by means of a neck 132. Neck 132 also may have at least one generally flat side 136. Neck 132 also may have a receptor 137. In the preferred embodiment, support member 130 is generally s-shaped.

To further secure the article, a securing tab 160 may be releasably engaged with receptors 122, 123 in collar 120. Securing tab 160 has a complimentary gear 161 to receptors 122, 123, and is tapered similarly to the taper angle on support member 130 to remain secured by friction. Securing tab 160 includes a protrusion 162 which permits easy insertion and removal of security tab 160 into collar 120 as desired. Protrusion 162 also provides for securing of the article to collar 120.

In a preferred embodiment, collar 120 may be manufactured using a thermoplastic polymer. This permits collar 120 to be flexible so that it may be compressed into a smaller diameter to, by way of example, fit watches that will fit a variety of wrist sizes.

In one embodiment, base adaptor 150 may be releasably coupled to base 140 or base 170. Base adaptor 150 has a first end 154 which is adapted to be releasably engageable to support member 130 and two second ends 153 which are adapted to be releasably engageable to either base 140 or base 170. Receptor 155 in first end 154 is offset from seat 151 to provide suitable space to releasably engage second end 133 of support member 130. Receptor 155 is generally square shaped, but may have any suitable geometric configuration to releasably engage second end 133 of support member 130, which is complimentarily shaped. Likewise, second ends 153 are tapered to releasably engage with receptors 145 of base 140. Tapering from seat 151 of second ends 153 provides a means for releasably engaging second ends 153 into receptors 145 while retaining them securely by means of friction. Second ends 153 are generally square shaped complementarily to receptor 145, but may be of any suitable geometric configuration.

Figure 3:
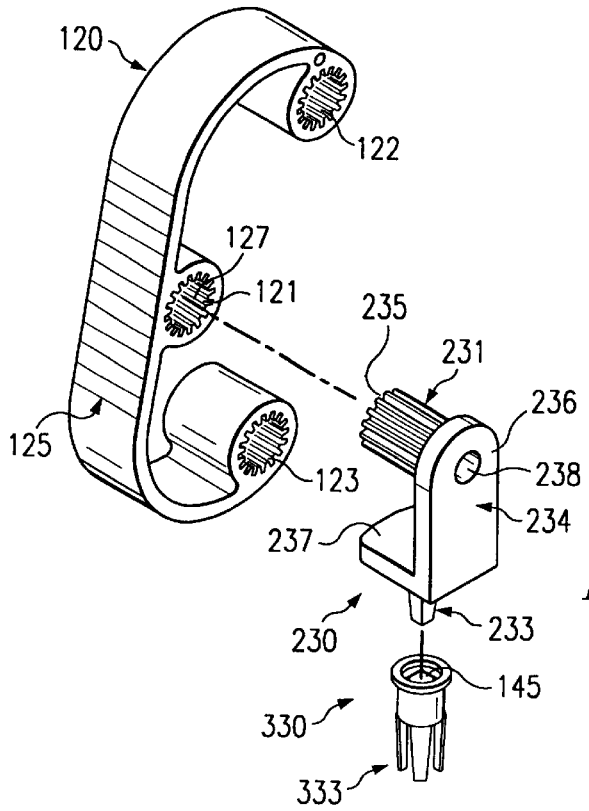
FIG. 3 shows a perspective view of the collar of FIG. 1 positioned vertically, where another embodiment of a base adapter may be used to engage with a base.

In this embodiment, base 140 is generally rectangularly shaped with two receptors 145 to receive second ends 153 of base adaptor 150. Base 140 has a height 142 that is both sufficient and suitable for receptor depth 145 to receive base adaptor 150 and to securely retain base adaptor 150 in place. Base 140 has a generally flat surface 141. Base 140 may be generally configured to receive one or more base adaptors 330, as illustrated in FIG. 3. Configuring base 140 to receive base adaptor 330 permits collar 120 to be coupled with a variety of bases 140. Base adaptor 330 is discussed in detail in conjunction with FIG. 3. FIG. 3 also discusses in detail coupling of collar 120 to base adaptor 330.

Base 170 is similarly adapted to receive second ends 153 of base adaptor 150. Base 170 is generally rectangularly shaped, with a plurality of slots 175 recessed from surface 171 which are generally rectangularly shaped in order to receive complimentarily shaped second ends 153. Second ends 153 of base adaptor 150 may be releasably engaged with slot 175 of base 170 and be securely held by friction. Base 170 has a generally flat surface 171 to securely fasten base adapter 150.

It is within the scope of the invention to utilize various price tag or display marker configurations with the invention. By way of example, securing tab 160 may include receptor 165, and support member 130 may include receptors 137 and 135, respectively, adapted to receive one end of a price tag, which may be releasably inserted to receptors 165, 137 or 135 to display a price of the article. The end of the price tag may be tapered and complimentarily shaped to receptors 165 or 135 to releasably secure the price tag into receptor 165 of securing tab 160 or receptor 135 of support member 130. Alternatively and also by way of example, the price tag may also be adhesive-backed such that it may be fastened to side 136 of support member 130, or to a side 236 of a support member 230, which is further described in FIGS. 2 and 3. FIGS. 2 through 5 illustrate the range of embodiments that may be achieved by coupling collar 120 to a variety of bases, using the teachings of the present invention.

Figure 2:
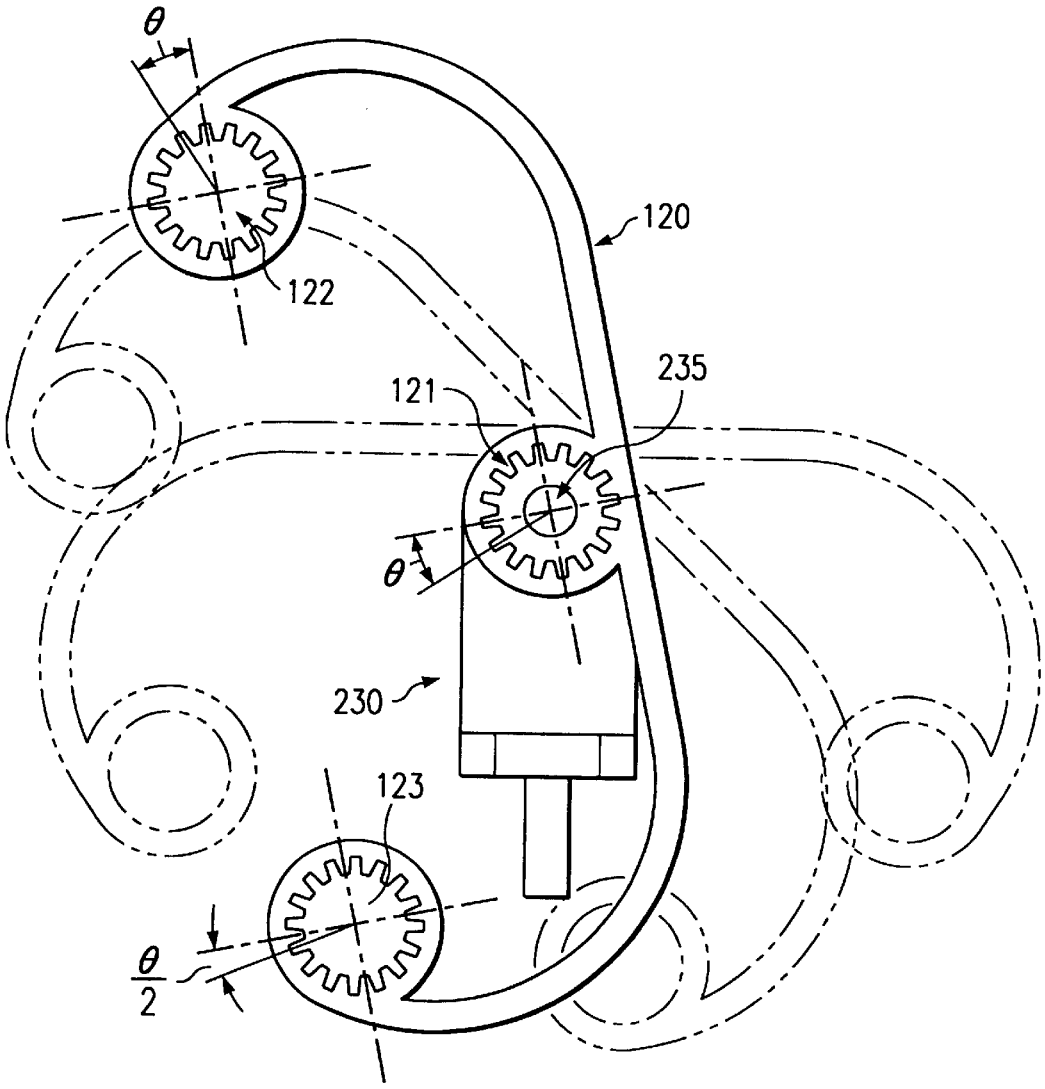
FIG. 2 illustrates a side view of the collar of FIG. 1 showing a range of vertical positional angles in which the collar may be positioned.

FIG. 2 illustrates a side view of collar 120 in a vertical position coupled to support member 230, which demonstrates a range of discrete angles at which the collar may be positioned to provide various viewing perspectives. Collar 120 may be coupled to support member 230 at centrally-located receptor 121 or either of the non-centrally located receptors 122, 123 to provide a variety of vertical display configurations.

In the preferred embodiment, receptors 121, 122, and 123 are geared to receive support member 230, which has a complimentary gear. The gears are adapted to releasably engage with receptors 121, 122, and 123, but will remain securely positioned by friction. This may be accomplished, by way of example, by tapering the complimentary gear on support member 230 which is described in further detail in FIG. 3.

In this embodiment, collar 120 has three receptors 121, 122, and 123, which are geared at equivalent gear ratios, as illustrated in FIG. 2. The gears in receptor 123 are rotated relative to receptors 121 and 122 to provide additional discrete angles at which collar 120 may be positioned relative to support member 230. A few of these discrete angles are illustrated in FIG. 2, where collar 120 is rotated about the axis of receptor 121. Similarly, collar 120 may be engaged with support member 230 at receptor 122 or 123. Collar 120 may be rotated about the axis of receptor 122 and positioned at a variety of discrete angles. Collar 120 may also be rotated about the axis of receptor 123, which permits collar 120 to be oriented in an additional plurality of discrete angles that differ from those achieved by using receptor 122, as a result of the relative rotation of gears in receptor 123. Thus, collar 120 may be coupled to support member 230 in three pluralities of discrete angular positions at receptor 121, 122, and 123.

Support member 230 also has receptors 235 and 238 that may be adapted to receive one end of a price tag, which may be releasably inserted to receptor 235 or 238 to display the price of the article, as discussed in conjunction with FIG. 1.

FIG. 3 illustrates another embodiment of the invention where support member 230 may be coupled to a base adaptor 330. Support member 230 may be releasably engaged with receptors 121, 122, and 123 of collar 120 in various angular positions to display the article in variety of orientations. As discussed in conjunction with FIG. 1, receptors 121, 122, and 123 has gears to receive a first end 231 of support member 230, which is complimentarily geared. Gear 127 and complimentarily geared first end 231 permit orientation of collar 120 in a plurality of discrete angular positions. Tapering of complimentarily geared first end 231 of support member 230 from a wider angle near leg 234 to a narrower end near end receptor 235 permits support member 230 to remain securely positioned to collar 120 by friction. The geared surface of first end 231 of support member 230 may become solid before abutting leg 234.

First end 231 of support member 230 is offset from leg 234, which extends to second end 233. Leg 234 may have at least one generally flat side 236, upon which an adhesive backed price tag may be fastened. Second end 233 of support member 230 is adapted to be releasably engageable to a variety of base adaptors by means of tapering to remain secured by friction. Such base adaptors include base adaptor 330, as shown in FIG. 3. Support member 230 also has a seat 237 to assist in releasably engaging support member 230 to base adaptor 330 at receptor 145. Receptor 145 is generally square shaped, but may have any suitable geometrical configuration which may releasably engage second end 233 of support member 230, which is complimentarily shaped.

Base adaptor 330 may be secured into a promotional display or other base, such as base 140 as depicted in FIG. 1, which is adapted to receive base adaptor 330. In this embodiment, end 333 of base adaptor 330 is flexible to allow insertion of base adaptor 330 into a complementary receptor of a promotional display or other base, such as base 140. By way of example, such a promotional display may be provided by a watch manufacturer desiring a selected arrangement of watches to be permanently displayed.

FIG. 4 illustrates another embodiment of the invention that uses a base adaptor 430. Base adaptor 430 is structured so that it may be secured into a slot wall 440, or may be used as a self-standing base. Base adaptor 430 has a generally flat surface 438 to permit base adaptor 430 to serve as a self-standing base. Base adaptor 430 has a receptor 437 adapted to receive, for example, second end 233 of support member 230, or second end 133 of support member 130. Receptor 437 is generally square shaped, but may have any suitable geometric configuration which may releasably engage second end 133 of support member 130, which is complimentarily shaped. Receptor 437 in first end 436 is offset from a seat 431 to provide suitable space to releasably engage second end 133 of support member 130. Base adaptor 430 has seat 431 that may be generally flat, as well as adapted to securely engage a slot wall 440. By way of example, structural textures such as ribbing may be introduced on seat 431 of adaptor 430 for more secure positioning into slot wall 440.

Slot wall 440 is adapted to receive a structure such as seat 431 of adaptor 430. Slot wall 440 is generally vertically oriented, with a plurality of slots 445 recessed from surface 447 that are generally rectangularly shaped in order to receive complimentarily shaped seat 431 of adaptor 430. Ribbed surface 435 of seat 431 of base adaptor 430 may be releasably engaged with slot 445 of slot wall 440 and be securely held by friction. Slot wall 440 may be used with collar 120 in both a horizontal and vertical orientation by means of support members 130 and 230, respectively, which provides for a variety of viewing angles and display configurations.

FIG. 5 shows the invention with securing tabs 160 and yet another base adaptor 530 and a molded base 540 adapted to receive base adaptor 530. Base adaptor 530 is similarly releasably engageable to support member 130 and to base 540 as discussed in conjunction with FIGS. 1 through 3. Second end 133 of support member 130 is adapted to releasably engage with receptor 535 of base adaptor 530 by means of tapering to remain secured by friction.

Base adaptor 530 has first end 534 which is adapted to be releasably engageable to support member 130, and a second end 533 which is adapted to be releasably engageable to base 540. Receptor 535 in first end 534 is offset from seat 531 to provide suitable space to releasably engage second end 133 of support member 130. Receptor 535 is generally square shaped, but may have any suitable geometric configuration which may releasably engage second end 133 of support member 130, which is complimentarily shaped. Likewise, second end 533 is tapered to releasably engage with receptor 545 of base 540. Tapering from seat 531 of second end 533 provides a means for releasably engaging second end 533 into receptor 545 while retaining second end 533 securely by means of a snap-lock fit. Second end 533 is generally rectangularly shaped, complimentarily to receptor 545, but may be of any suitable geometric configuration.

Base 540 is generally rectangularly shaped and self-standing. By way of example, molded base 540 may be used for other display retail needs, such as rings on molded ring finger displays or other articles for sale. Base adaptor 530 thus permits molded base 540 to be used to display articles for which collar 120 is adapted. This enables retailers to utilize molded base 540 for a broader variety of needs.

Figure 6:
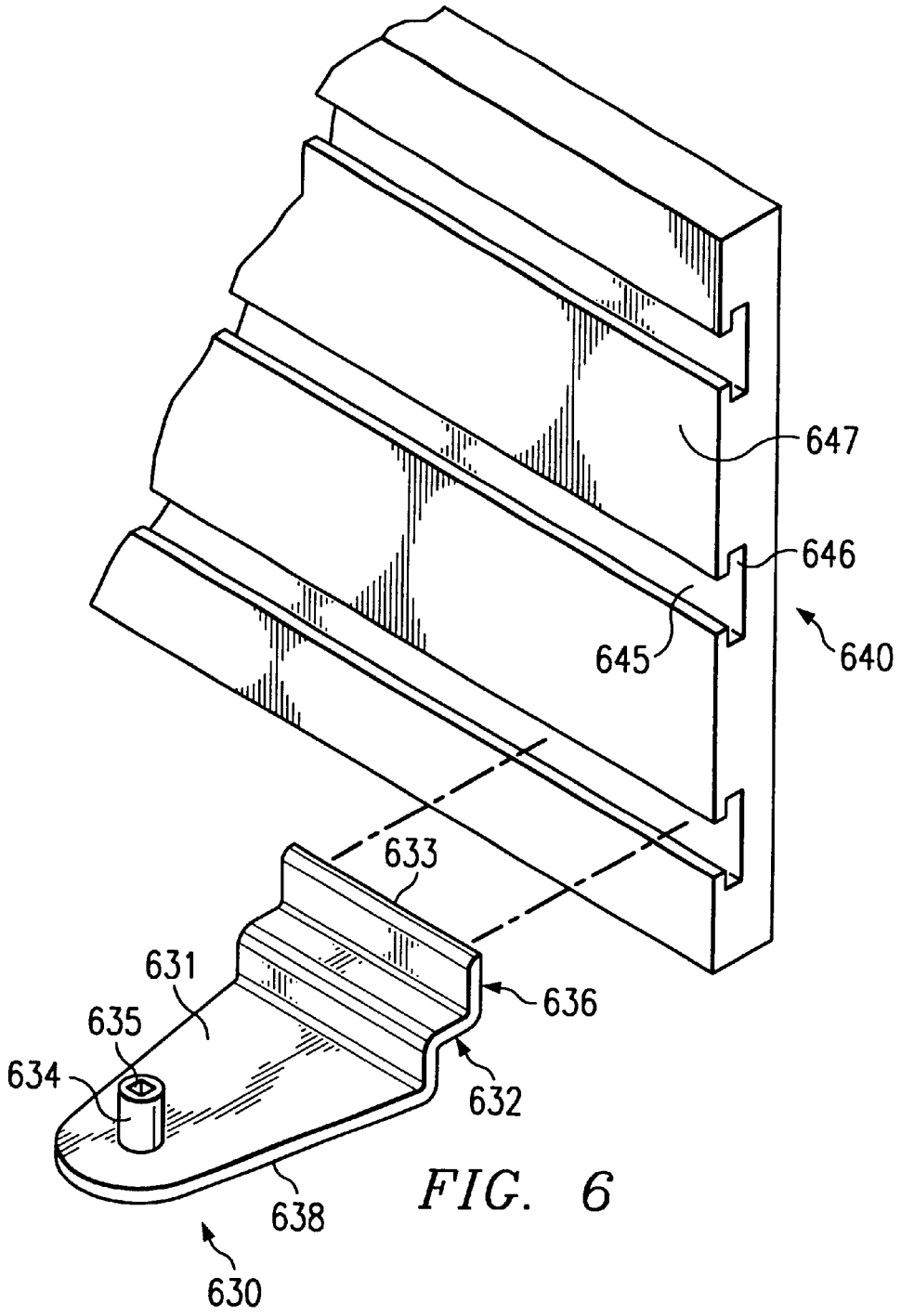
FIG. 6 illustrates another embodiment of the invention with a base adaptor that may be used with a slat wall.

FIG. 6 illustrates another embodiment of the invention that uses a base adaptor 630. Base adaptor 630 is structured so that it may be secured into a slatwall 640, or may be used as a self-standing base. Base adaptor 630 has a generally flat surface 638 to permit base adaptor 630 to serve as a self-standing base. Base adaptor 630 has a receptor 635 adapted to receive, for example, second end 233 of support member 230 (as shown in FIG. 3), or second end 133 of support member 130 (as shown in FIG. 2). Receptor 635 is generally square shaped, but may have any suitable geometric configuration that may releasably engage second end 133 of support member 130, which is complimentarily shaped. Receptor 635 in first end 634 is offset from seat 631 to provide suitable space to releasably engage second end 133 of support member 130.

Slatwall 640 is generally vertically oriented, with a plurality of slats 645 recessed from surface 647 that are generally T-shaped. Slats 645 of slatwall 640 are adapted to receive complimentarily shaped second end 636 of adaptor 630. Second end 636 of base adaptor 630 may be releasably engaged with slat 645 of slatwall 640 and be securely held by friction. In this embodiment, second end 636 is offset from seat 631 in a double-L-shape. Seat 632, offset by the first L-shaped offset from seat 631, provides a ledge for base adaptor 630 to be seated on slat 645 of slatwall 640. Second end 636 has a depth 633 suitable to releasably engage the upper portion 646 of T-shaped slats 645 of slatwall 640. Second end 636 may be offset from seat 631 in any other suitable manner to releasably engage slatwall 640.

Slatwall 640 may be used with collar 120 in both a horizontal and vertical orientation by means of support members 130 and 230, respectively, which provides for a variety of viewing angles and display configurations. By way of example, slatwall 640 may be used for other retail needs which utilize hanger brackets or wire hooks for displaying articles such as socks, or displaying articles on shelves. Base adaptor 630 thus permits slatwall 640 to be used to display articles for which collar 120 is adapted. This enables retailers to utilize slatwall 640 for a broader variety of needs.

While the invention has been particularly shown and described by the foregoing detailed description, it will be understood by those skilled in the art that various other changes in form and detail may be made without departing from the spirit and scope of the invention.

What is claimed is:

1. An apparatus for displaying articles comprising:

a. a collar adapted to receive an article, the collar having at least one receptor, the receptor having a gear, the gear comprising a plurality of teeth, the number of teeth greater than four;

b. a base for supporting the collar; and c. a support member having a first end adapted for releasably engaging the gear of the receptor in a plurality of discrete angles, the number of discrete angles corresponding to the number of teeth, and a second end for coupling the support member to the base.

2. The apparatus of claim 1 wherein the collar has a centrally-located receptor.

3. The apparatus of claim 1 wherein at least one of the plurality of receptors is not centrally located.

4. The apparatus of claim 1 wherein at least one of the plurality of receptors has a gear adapted to receive the support member, and the first end of the support member has a complementary gear.

5. The apparatus of claim 1 wherein the support member is generally s-shaped.

6. The apparatus of claim 1 wherein the second end of the support member is adapted to engage a base adaptor, the base adaptor further having an end adapted to engage the base.

7. The apparatus of claim 1 wherein the second end of the support member is adapted to engage a base adaptor, the base adaptor further having an end adapted to engage a display structure.

8. An apparatus for displaying articles comprising:

a. a collar adapted to receive an article, the collar having two receptors, each of the receptors having a gear, each of the gears comprising a plurality of teeth, the number of teeth greater than four;

b. a base for supporting the collar; and c. a support member having a first end adapted for releasably engaging the gear of each of the two receptors in a plurality of discrete angles, the number of discrete angles corresponding to the number of teeth, and a second end for coupling the support member to the base.

9. The apparatus of claim 8 wherein the collar is operable to engage with the support member in a multiplicity of angular positions.

10. The apparatus of claim 8 wherein the collar is operable to engage with the support member in a multiplicity of discrete positions.

11. The apparatus of claim 8 wherein the support member has a generally cylindrical end which is adapted to engage at least one of the two receptors.

12. The apparatus of claim 8 wherein the support member further comprises:

a. the support member having an end adapted to engage a base adaptor; and b. the base adaptor further having an end adapted to engage the base.

13. A method for displaying an article comprising:

a. mounting the article on a collar, the collar having a plurality of receptors, each of the receptors having a gear comprising a plurality of teeth, the number of teeth greater than four, the gear operable to be engaged with a complementary gear of a support member in a plurality of discrete angles, the number of discrete angles corresponding to the number of teeth;

b. engaging the gear of one of the receptors with the complementary gear of the support member; and c. coupling the support member to a base.

14. A method for displaying an article comprising:

a. mounting the article on a collar, the collar having at least one receptor;

b. engaging the collar with a support member; and c. coupling the support member to a base.

15. The method of claim 14 wherein the step of coupling comprises:

a. engaging the support member to a base adaptor suitable to engage with the base; and b. engaging the base adaptor with the base.

16. The method of claim 14 wherein the steps of engaging comprises engaging the collar with the support member in a position which may be replicated.

17. The method of claim 14 wherein the step of engaging comprises engaging the collar with the support member, where the collar has a centrally-located receptor.

18. The method of claim 14 wherein the step of engaging comprises engaging the collar with the support member, where the collar has a receptor which is not centrally-located.

19. The method of claim 14 further comprising the step of mounting a securing tab to secure the article.

20. An apparatus for displaying articles comprising:

a. a collar adapted to receive an article, the collar having two receptors, each of the receptors comprising a gear, each of the gears comprising a plurality of teeth, the number of teeth greater than four;

b. a base for supporting the collar;

c. a base adaptor having an end adapted to engage the base; and d. a support member having a first end, the first end having a complementary gear for releasably engaging the gear of one of the two receptors in a plurality of discrete angles, the number of discrete angles corresponding to the number of teeth, and having a second end adapted to engage the base adaptor.

* * * * *